United States Patent [19]

DeRosier et al.

[11] Patent Number: 5,015,983

[45] Date of Patent: May 14, 1991

[54] COMPACT CIRCUIT INTERRUPTER HAVING MULTIPLE AMPERE RATINGS

[75] Inventors: Donna C. DeRosier; Richard A. Dziura, both of Plainville; Joseph M. Palmieri, Southington; Eric D. Juntwait, Plainville; Linda Y. Jacobs, Barkhamsted; Graham A. Scott, Avon, all of Conn.

[73] Assignee: General Electric Company, New York, N.Y.

[21] Appl. No.: 539,399

[22] Filed: Jun. 18, 1990

[51] Int. Cl.[5] ..... H01H 71/08

[52] U.S. Cl. ..... 336/180; 336/173

[58] Field of Search ..... 336/170–176, 336/180–185, 188

[56] References Cited

U.S. PATENT DOCUMENTS

| | | | |
|---|---|---|---|
| 2,771,587 | 11/1956 | Henderson | 336/172 |
| 3,028,567 | 4/1962 | Mittermaier | 336/213 |
| 3,321,725 | 5/1967 | Canney . | |
| 4,281,359 | 7/1981 | Bayer et al. . | |
| 4,591,942 | 5/1986 | Willard et al. . | |
| 4,728,914 | 3/1988 | Morris et al. . | |
| 4,741,002 | 4/1988 | Dpugherty . | |
| 4,746,891 | 5/1988 | Zylstra | 336/171 |
| 4,754,247 | 6/1988 | Raymont et al. . | |
| 4,788,621 | 11/1988 | Russell et al. . | |
| 4,894,632 | 1/1990 | Castonguay et al. . | |
| 4,907,342 | 3/1990 | Castonguay et al. . | |

*Primary Examiner*—Gerald P. Tolin
*Assistant Examiner*—Lincoln Donovan
*Attorney, Agent, or Firm*—Richard A. Menelly; Walter C. Bernkopf; Fred Jacob

[57] ABSTRACT

A compact circuit breaker containing an electronic trip unit for interrupting overcurrent conditions within a protected circuit is made operable over a wide operating current range by means of current transformers having multiple turn primary windings. The primary windings are selected to provide a constant ampere-turns ratio to the current transformers without changing the size of the secondary winding or the volume of the transformer core.

12 Claims, 4 Drawing Sheets

COMPACT CIRCUIT INTERRUPTER HAVING MULTIPLE AMPERE RATINGS

BACKGROUND OF THE INVENTION

The use of electronic trip units within low-ampere industrial rated circuit breakers has heretofore been forestalled because of size constraints on the discreet electrical and electromagnetic components within the circuit breaker enclosure. The current transformer used in conjunction with the electronic trip unit, has a two-fold requirement namely, to provide an input signal to the trip unit representative of the current flow within the associated protected power circuit while providing the necessary input power to the trip unit power supply. A predetermined maximum core volume is required within the current transformer to ensure that the current transformer does not become magnetically saturated upon the occurrence of overcurrent conditions when used within compact circuit breakers having variable ampere ratings while a predetermined minimum core volume insures that the core will become sufficiently magnetized at the lower steady-state operating current levels.

With earlier-designed electronic trip circuit breakers, such as described within U.S. Pat. No. 4,281,359, for example, a standard trip unit circuit is employed over a wide range of ampere ratings while the size of the current transformer used to sense the input current to the trip unit circuit is correspondingly increased in proportion to the increased ampere rating.

When compact electronic trip unit circuit breakers employing various accessory devices, such as described in U.S. Pat. No. 4,754,247, are used within industrial-rated power distribution circuits, the size constraints of the circuit breaker enclosure limit the geometry of the current transformer core to a size just sufficient to provide operating power to the electronic trip unit circuit without becoming saturated at the higher ampere ratings due to the low inductance of the smaller core. Another problem involved with the use of small-sized current transformer cores is the lack of sufficient core inductance to provide the requisite core magnetization for transformer operation at the lower ampere ratings.

One purpose of the instant invention accordingly, is to provide an electronic trip circuit breaker for industrial power distribution circuits whereby a single current transformer core size fits within the circuit breaker enclosure and supplies sufficient sensing current and operating power to the trip unit circuit over a wide range of circuit breaker ampere ratings.

SUMMARY OF THE INVENTION

A compact electronic trip circuit breaker of the type employing a signal processor circuit in combination with a current sensing transformer and a burden resistor utilizes a fixed transformer core size and a fixed secondary winding on the core to meet the size constraints of the compact circuit breaker enclosure. The circuit breaker rating requirements are met by varying the number of primary turns on the transformer core to maintain a constant input power to the trip unit electronics without sacrificing the current transformer sensitivity. The size of the core and the number of turns within the secondary winding are selected to ensure that the input power to the electronic trip unit remains constant when the number of primary turns are varied in inverse relation to the circuit breaker ampere rating.

DESCRIPTION OF THE PREFERRED EMBODIMENT

Figure 1:
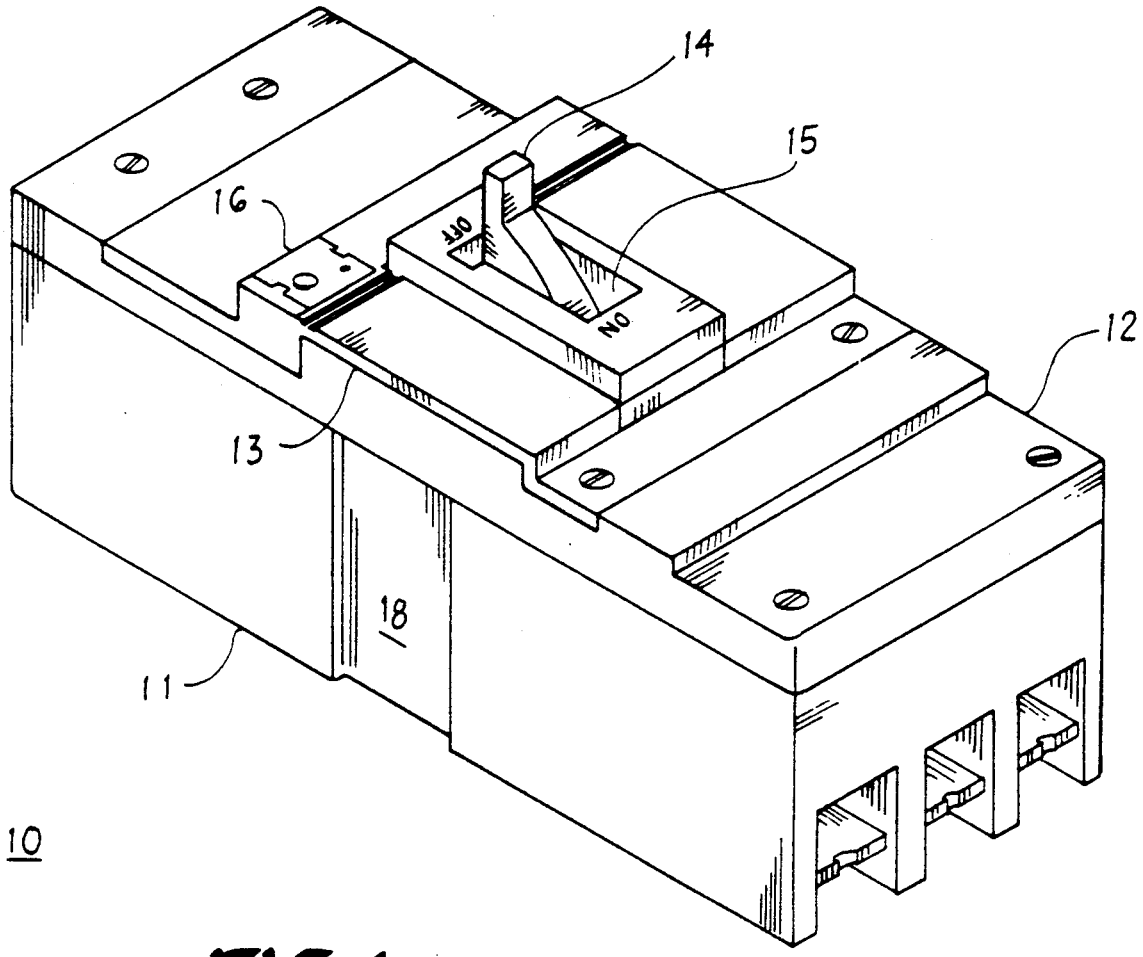
FIG. 1 is a top perspective view of a compact electronic trip circuit breaker employing the current transformer arrangement according to the invention.

A compact electronic trip circuit breaker 10 hereafter "electronic circuit breaker" is depicted in FIG. 1 wherein the circuit breaker case 11 containing the circuit breaker components is sealed by means of a circuit breaker cover 12 and an accessory cover 13. The circuit breaker is switched ON and OFF by means of a handle operator 14 which projects through the handle slot 15 formed within the circuit breaker cover 12. An externally-accessible rating plug 16 fits within the accessory cover for setting the circuit breaker ampere rating. A wiring access slot 18 formed in the side of the case provides for the egress of electrical wire conductors for electrically accessing the circuit breaker accessories contained therein.

Figure 2:
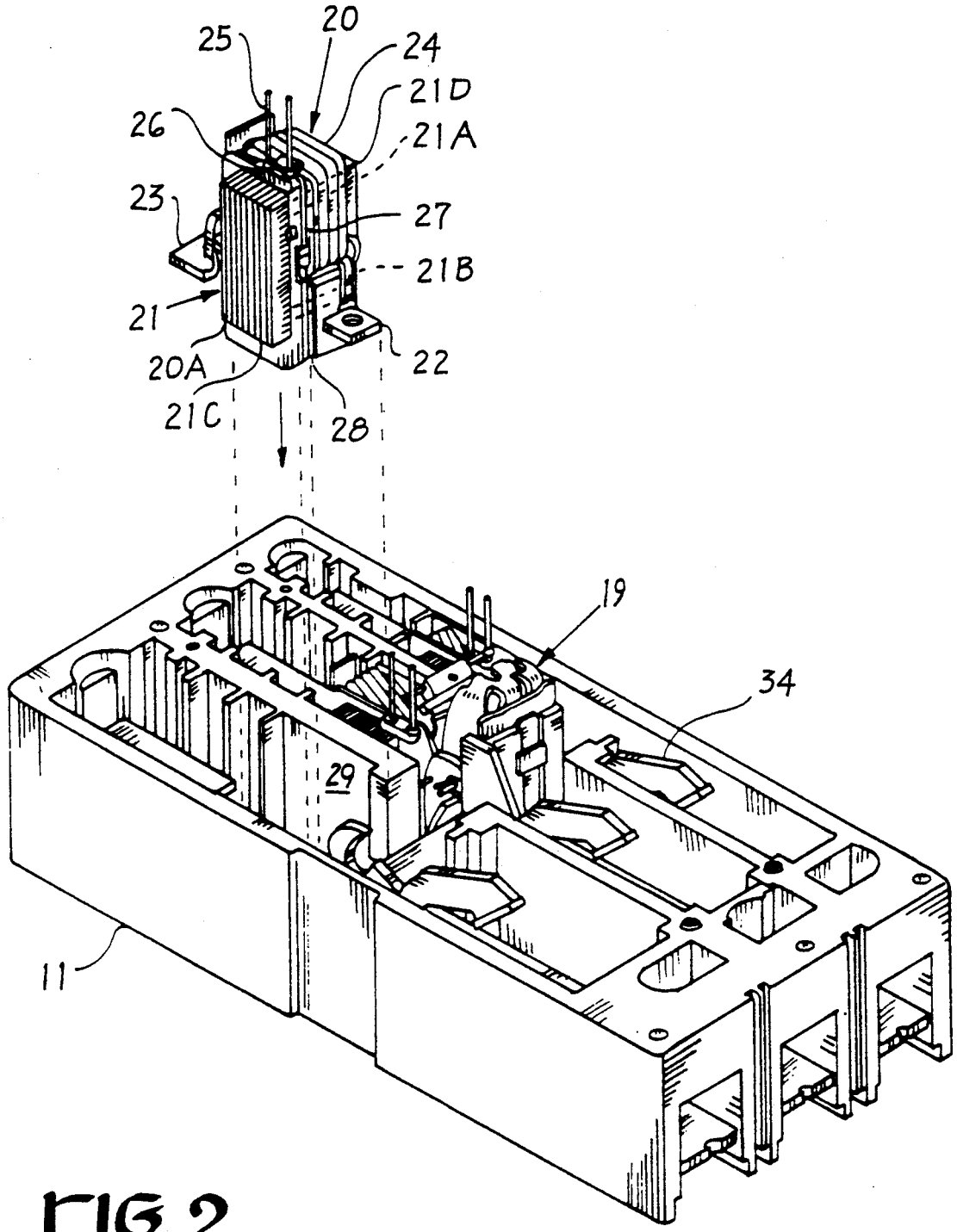
FIG. 2 is a top perspective view of the circuit breaker case of FIG. 1 with one of the current transformers in isometric projection.
Figure 3:
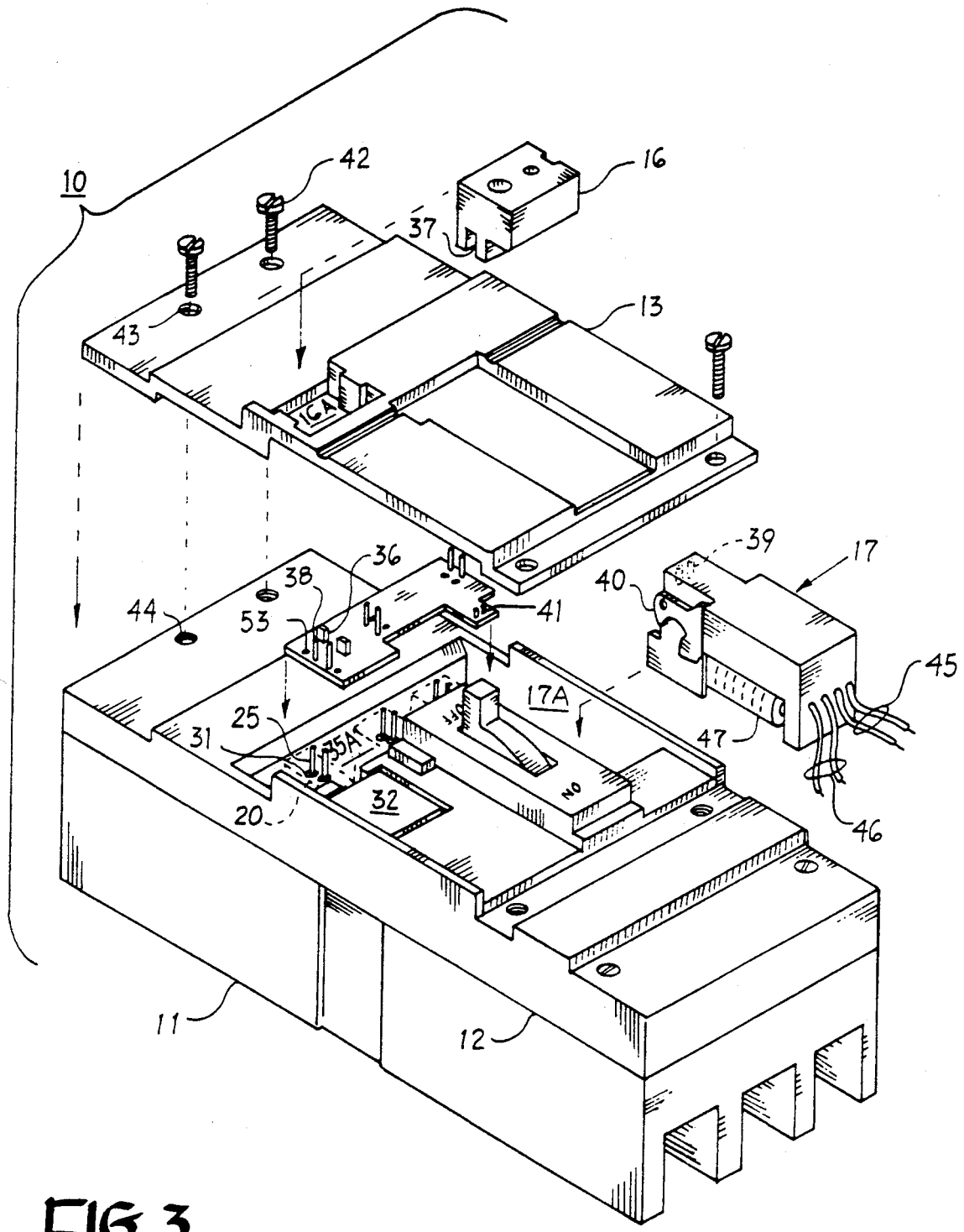
FIG. 3 is a top perspective view of the circuit breaker of FIG. 1 with the trip circuit and associated discrete electronic components in isometric projection relative to the circuit breaker cover.

The circuit breaker case 11, shown in FIG. 2, is fitted with a circuit breaker operating mechanism 19 such as described in U.S. Pat. No. 4,894,632. The operating mechanism controls the movement of the movable contact arm 34 in response to the actuator-accessory unit 17 and the trip circuit contained within the printed circuit wiring board 35 (FIG. 3). Three current transformers 20 are summarily inserted within corresponding transformer recesses 29 formed within the circuit breaker case. The current transformer, in accordance with the invention, is a multiple turn primary current transformer that includes a line terminal connector 22 on one side of the core 21 and a load terminal connector 23 on an opposite side thereof. The current transformer of this invention differs from that described within U.S. Pat. No. 4,591,942 by the use of the multiple turn primary winding 24 and differs from the multi-turn primary current transformer described within U.S. Pat. No. 3,321,725 by the improvision of a separate pair of secondary windings, 27, 28 which are individually arranged about the top and bottom crosspieces 21A, 21B of the rectangular core 21. The secondary windings 27, 28 each pass through the rectangular slot which is defined between the core side pieces 21C, 21D and the core crosspieces 21A, 21B. The secondary windings 27, 28 electrically connect with the transformer pin connectors 25 upstanding from the core crosspiece 21A and includes a transient voltage suppressor 26 as described in the aforementioned U.S. Pat. No. 4,907,342. The multiple turn current transformer 20 in accordance with the invention, allows the electronic circuit breaker to be used within lower-ampere rated industrial power distribution circuits wherein electronic trip units were heretofore economically infeasible. The close confines of the transformer recess 29 limit the rectangular core volume of the metal laminations depicted at 20A to less than 1 cubic inch. For circuit breakers having IEC and UL ampere ratings between 10 and 30 amperes, this core volume allows steady state current transfer through the current transformer primary and secondary windings with negligible heating effects. The core is readily magnetizable at the lower current ratings without incurring magnetic core saturation under ,momentary severe overcurrent conditions. With a constant secondary winding size of 25 ampere-turns, the input current to the trip unit circuit is maintained at approximately 100 milliamps by increasing the number of turns within the primary winding 24 in inverse proportion to the circuit breaker ampere rating. It has been determined, that by adjusting the number of turns of the primary winding to compensate for the different ampere ratings, an optimum turns ratio for both the primary and secondary windings can be maintained. The so-called "turns ratio" is defined herein as the ratio of the transformer primary current to the number of transformer primary turns.

The electronic circuit breaker 10 is depicted in FIG. 3 with the current transformers 20 assembled within the circuit breaker case 11 such that the transformer pin connectors 25 extend upwards through the openings 31 formed in the printed wire board recess 35A. Three such transformers are employed, one for each separate phase of the electrical distribution circuit to which the electronic circuit breaker is connected. An auxiliary switch 32 is depicted next to the printed wire board recess and the actuator-accessory unit 17 is depicted prior to insertion within the actuator-accessory recess 17A. The printed wire board 35 is inserted within the printed wire board recess 35A. When these components are inserted within the respective recesses in the cover 12, the accessory cover 13 is attached to the circuit breaker cover by means of screws 42, thru-holes 43 and threaded openings 44. The rating plug 16 is next inserted within the rating plug recess 16A in the accessory cover to complete the electronic circuit breaker assembly. The printed wire board 35 contains an electronic trip circuit such as that described within U.S. Pat. No. 4,741,002. The printed wire board electrically connects with the current transformers 20 by attachment between the pins 38 upstanding on the printed wire board next to the thru-holes 53 through which the transformer pin connectors extend. When the printed wire board is electrically connected with the current transformers, the actuator-accessory unit 17 is positioned over a part of the printed wire board such that the printed wire board pins 41 are received within the connector sockets 39 that are formed within the housing of the actuator-accessory unit described within U.S. Pat. No. 4,788,621. The rating plug 16 connects with the printed wire board 35 by positioning the connectors 37 formed on the bottom of the rating plug over the pins 36 upstanding from the printed wire board. The rating plug is described within U.S. Pat. No. 4,728,914. As further described in aforementioned U.S. Pat. No. 4,788,621, the actuator-accessory unit includes an electromagnetic coil 47 that controls the operation of the actuator lever 40 which interacts with the operating mechanism 19 shown in FIG. 2 to electrically disconnect the protected circuit upon receipt of signals transmitted from the electronic trip circuit within the printed wire board 35. The actuator-accessory unit connects with a remote voltage source or a remote switch by means of a first pair of conductors 45 to provide shunt trip and undervoltage release facility to the actuator-accessory unit. The solenoid 47 electrically connects with the printed wire board 35 over a separate pair of conductors 46. The electrical interconnection between the current transformers and the trip unit circuit on the printed wire board 35 is described in U.S. Pat. No. 4,907,342 which Patent and all previously mentioned Patents are incorporated herein for reference purposes and should be reviewed for their teachings of the advanced state of the art of electronic circuit breakers.

Figure 4:
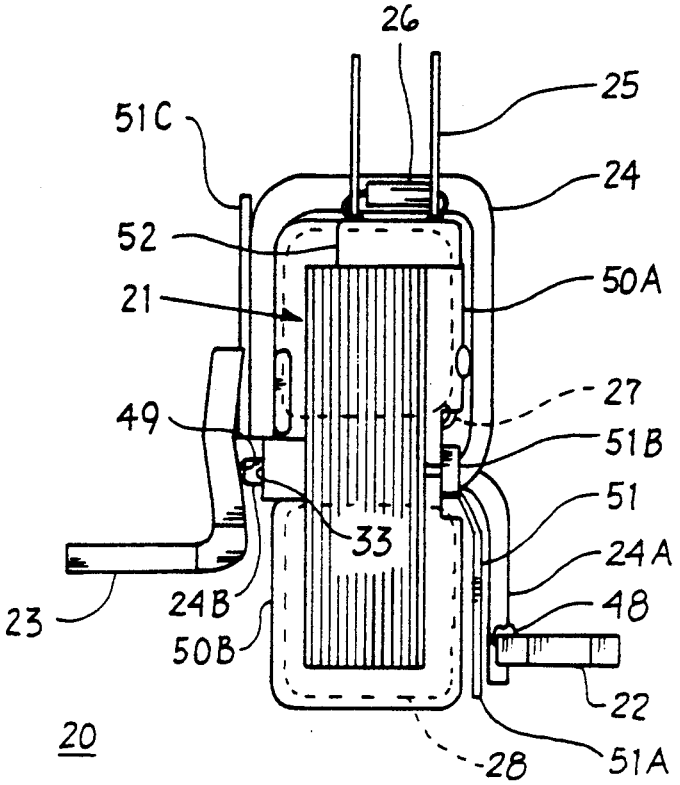
FIG. 4 is an enlarged front plan view of the current transformer shown in FIG. 2.

The multiple turn primary current transformer 20 is depicted in FIG. 4 to show the attachment between one turn 24A of the multiple winding primary 24 by means of a weld or braze 48 and the line terminal connector 22 on one side of the core 21 and the attachment between a separate turn 24B of the multiple primary winding and the load terminal connector 23 on the opposite side thereof by means of the weld or braze 49.

The secondary winding bobbins 50A, 50B served to insulate the top and bottom secondary windings 27, 28 from the core 21 while one end 51A of a flat fiber sheet 51 serves to electrically insulate the multiple turn primary winding 24 from the bottom secondary winding 28. A center part 51B of the fiber sheet insulates that part of the primary winding that passes through the rectangular transformer slot 33 and an opposite end 51C of the fiber sheet insulates the primary winding from the top secondary subwinding 27. A plastic block 52 extending from and integrally-formed with the secondary winding bobbin 50A supports the transformer pin connectors 25 and the interconnecting transient voltage suppressor 26.

Figure 5:
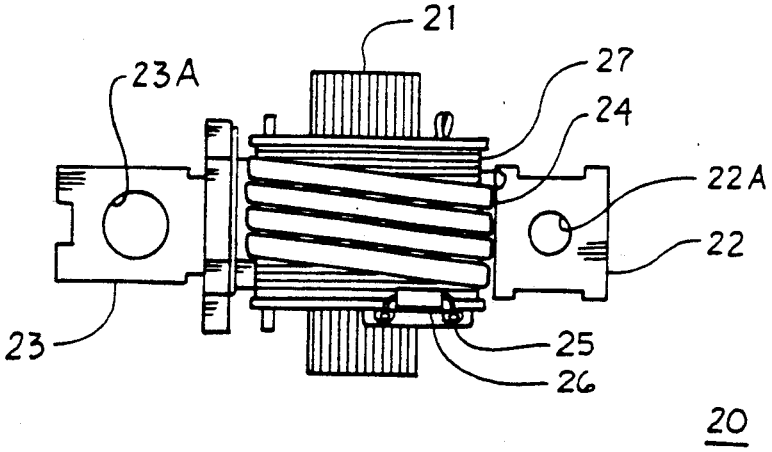
FIG. 5 is an enlarged top plan view of the current transformer of FIG. 2.

The arrangement of the multiple turn primary winding 24 about the core 21 of the current transformer 20 is best seen by referring now to FIG. 5 where the transformer pin connectors 25 extend upwardly from the top secondary winding 27 and the transient voltage suppressor 26 extends between the transformer pin connectors. Connection between the line terminal connector 22 and the movable contact arm 34 (FIG. 2) is made by means of thru-hole 22A and the load terminal connector 23 connects with an external load strap by means of thru-hole 23A.

A compact electronic trip circuit breaker that finds application within lower-rated industrial power delivery circuits has herein been described having a multiple turn primary current transformer of constant core volume and constant secondary winding size. The current transformer operation is optimized adjusting the number of turns of each primary winding in inverse proportion to the electronic circuit breaker ampere rating in order to maintain a constant input power to the electronic trip unit circuit without interfering with the transformer efficiency at the lower and higher ampere ratings.

Having thus described our invention, what we claim as new and desire to secure by Letters Patent is:

1. A compact circuit breaker having variable ampere ratings comprising:

a molded plastic circuit breaker cover and a molded plastic circuit breaker case;

an operating mechanism within said case arranged for separating a pair of contacts upon occurrence of an overcurrent condition through said contacts for a predetermined period of time;

an electronic trip unit circuit arranged within said circuit interrupter cover for controlling operation of said operating mechanism and;

a current transformer within said case connected with said trip unit circuit for providing operating power to said trip unit circuit and for providing a current signal to said trip unit circuit representative of current flow through a protected circuit;

said current transformer comprising a rectangular core of predetermined size and a secondary winding consisting of a predetermined number of turns arranged about said core, said current transformer further comprising a multiple turn primary winding arranged about said core, whereby a preselected ampere rating to said trip unit circuit is selected by a number of primary turns selected for said primary winding.

2. The circuit breaker of claim 1 wherein said current transformer primary winding comprises two turns arranged about said rectangular core.

3. The circuit breaker of claim 1 wherein said current transformer primary winding comprises three turns arranged about said rectangular core.

4. The circuit breaker of claim 1 wherein said current transformer primary winding comprises four turns arranged about said rectangular core.

5. The circuit breaker of claim 1 wherein said current transformer primary winding comprises five turns arranged about said rectangular core.

6. The circuit breaker of claim 1 wherein said rectangular core comprises a plurality of opposing side pieces joined at their ends by a plurality of top and bottom crosspieces.

7. The circuit breaker of claim 6 wherein said secondary winding comprises a first and second subwinding, said first subwinding being arranged around said top crosspieces and said second subwinding being arranged around said bottom crosspieces.

8. The circuit breaker of claim 7 wherein said primary winding is arranged around one of said first or second subwindings.

9. The circuit breaker of claim 7 wherein said first and second subwindings are arranged around first and second insulated winding spools.

10. The circuit breaker of claim 9 wherein said first winding spool includes an insulated block attached to one end, said insulated block supporting a pair of upstanding pin connectors connecting with said secondary winding.

11. The circuit breaker of claim 10 further including a transient voltage suppressor connecting across said pin connectors.

12. The circuit breaker of claim 11 including an S-shaped fiber insulator passing through a rectangular opening defined within said rectangular core for providing electrical isolation to said multiple primary winding.

* * * * *